United States Patent [19]

Cameron

[11] 4,113,291

[45] Sep. 12, 1978

[54] SECURITY LOCKING SYSTEM

[75] Inventor: Gordon Cameron, Greenwood, S.C.

[73] Assignee: McGraw-Edison Company, Elgin, Ill.

[21] Appl. No.: 777,050

[22] Filed: Mar. 14, 1977

[51] Int. Cl.[2] ..... E05C 1/06; E05B 13/02

[52] U.S. Cl. ..... 292/40; 70/230; 70/424; 70/427; 70/DIG. 63; 151/59; 174/50; 292/281

[58] Field of Search ..... 292/5, 6, 7, 40, 281, 292/DIG. 2; 70/78, 54, 55, 56, 229, 230, 232, 423, 424, 425, 426, 427, 428, DIG. 43, DIG. 56, DIG. 57, DIG. 63; 151/54, 59, 65, 67; 174/50

[56] References Cited

U.S. PATENT DOCUMENTS

| | | | |
|---|---|---|---|
| 458,525 | 8/1891 | Farlow | 292/6 |
| 596,050 | 12/1897 | Byrnes | 292/40 |
| 1,145,256 | 7/1915 | Mochow et al. | 151/54 |
| 1,332,268 | 3/1920 | Mainka | 151/59 |
| 1,711,535 | 5/1929 | Leet | 70/230 |
| 1,788,118 | 1/1931 | Meyer | 70/DIG. 56 X |
| 2,272,145 | 2/1942 | Anderson et al. | 292/7 |
| 3,338,611 | 8/1967 | Bertovich et al. | 292/281 |
| 3,486,797 | 12/1969 | Osborne | 151/59 X |
| 3,496,742 | 2/1970 | Rothweiler et al. | 70/232 |
| 3,572,062 | 3/1971 | Beebe | 292/281 |
| 4,005,253 | 1/1977 | Walter | 70/229 X |

FOREIGN PATENT DOCUMENTS

| | | | |
|---|---|---|---|
| 570,705 | 1/1924 | France | 292/6 |
| 928,141 | 5/1947 | France | 70/232 |
| 802,433 | 2/1951 | Fed. Rep. of Germany | 85/45 |
| 138,281 | 2/1920 | United Kingdom | 85/45 |
| 227,884 | 1/1925 | United Kingdom | 292/281 |

*Primary Examiner*—Roy D. Frazier
*Assistant Examiner*—Thomas J. Holko
*Attorney, Agent, or Firm*—Thomas E. McDonald; Jon Carl Gealow; Ronald J. LaPorte

[57] ABSTRACT

A combination door handle and security locking system in which the conventional door latch is actuated by turning the five-sided head of an operating shaft with a special socket wrench. A hinge plate having a slot for a padlock bail and a flat index tab on its inner surface is rotated to cover the operating shaft head. The tab must fit against one side of the operating shaft head to allow the hinge plate to be fully closed so that a padlock can be inserted in the bail. The latching mechanism is designed so that this tab will fit against one side of the operating head when the door is fully latched, to thus prevent rotation of the latching mechanism. The free end of the hinge plate has an offset portion which serves both as a sleet hood for the padlock and as a handle for opening the door.

4 Claims, 8 Drawing Figures

FIG. 1
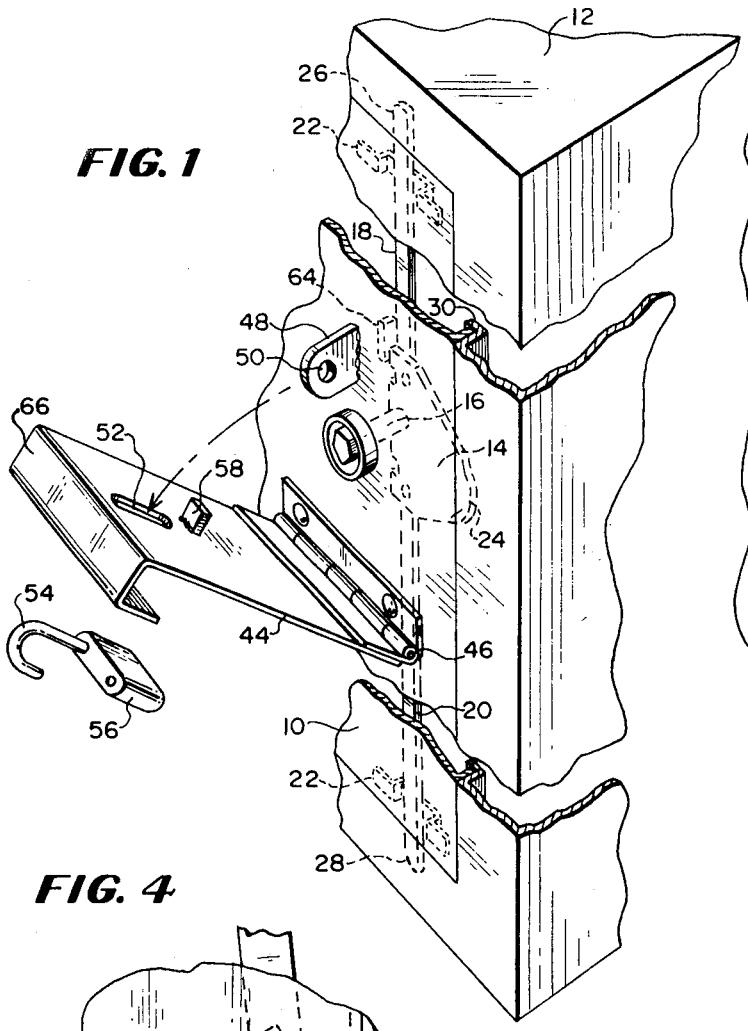
FIG. 2
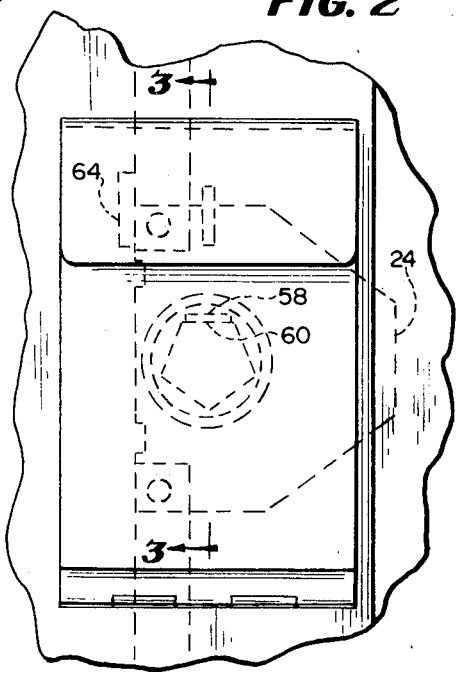
FIG. 3
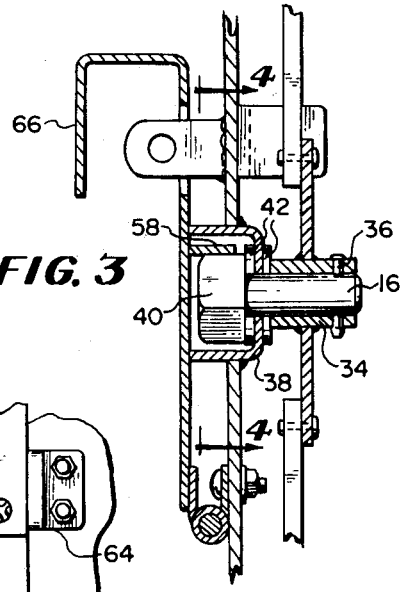
FIG. 4
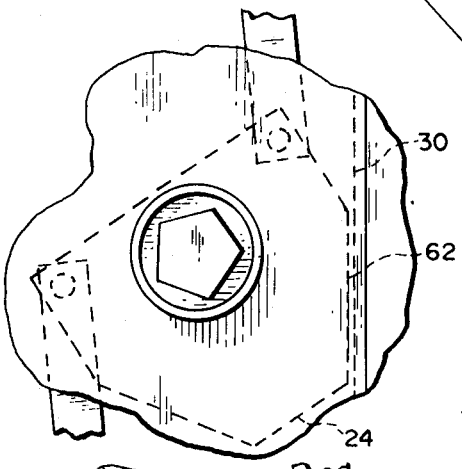
FIG. 6
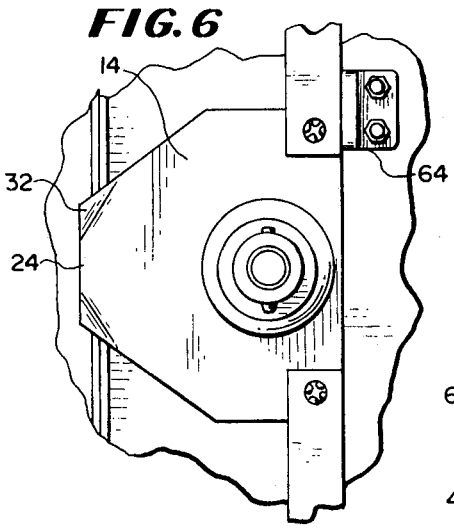
FIG. 7
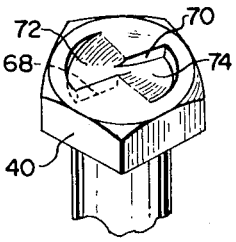
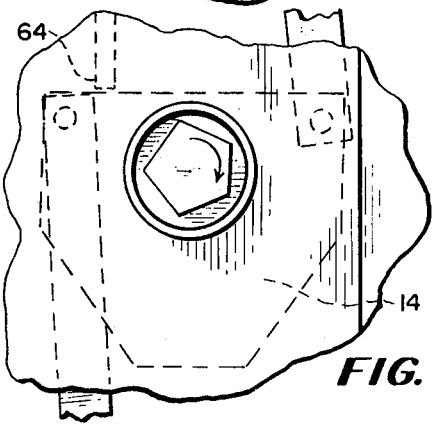
FIG. 5

SECURITY LOCKING SYSTEM

BACKGROUND OF THE INVENTION

1. Field of the Invention

The present invention relates to locking devices and, more particularly, to combination door latching and locking mechanisms.

2. Description of the Prior Art

In the past, the access door for the housings of pad-mounted power transformers have included the well known three-point latching system actuated by rotation of a door handle which may be padlocked in its closed position. In addition to these regular locking provisions, further tamperproof devices are used to secure the high voltage access door of these housings to assure that only authorized electric utility employees are able to open these doors. One such device which is commonly used and which is required by the R.E.A. specifications for these housings, is a penta-head threaded bolt held captive in a circular recessed portion of the access door and engaging with a retaining nut held by the door frame to thus secure the access door to the housing, which can only be turned by inserting a special socket tool into the door recess over the five-sided bolt head. Thus, to secure this door, this special bolt must be threaded into a blind nut held by the door frame; consequently, slight misalignments between the door and its frame, which would otherwise be permissible, make it very difficult, if not impossible, to properly secure this bolt to its retaining nut.

SUMMARY OF THE INVENTION

In the present invention, an operating shaft for a standard door latching mechanism can be rotated approximately 90° between a fully closed and a fully opened position. One end of this shaft extends through the door into a recessed outside portion of the door, with the end of this shaft within the recessed area being shaped so that the shaft can be turned by inserting a tool, such as a socket wrench, into the recess over the end of the shaft. The end of the shaft can have a special shape, so that a specially shaped tool is normally required to rotate the shaft. A hasp, which is hinged to the outside of the door, can be closed to cover the recess and prevent access to the end of the operating shaft therein. This hasp can be padlocked in its closed position by inserting the shackle of a padlock through a staple attached to the outside of the door which extends through a slot in the hasp when the hasp is in its closed position. The hasp also includes a flat index tab on its inner surface, which extends into the door recess and against a flat side of the end of the operating shaft when this operating shaft is in its fully closed position, to thus lock the shaft in this position when the hasp is closed. Also, the free end of the hasp is U-shaped in cross section so that it extends over and in front of the padlock bail or staple when the hasp is closed, thus serving both as a sleet shield for the padlock and as a handle to open the door after it is unlatched. Since the tamperproof device for securing the door by use of a special tool is also the normal means for latching the door, there is no difficulty encountered in securing the door caused by slight misalignment with the door and its frame.

BRIEF DESCRIPTION OF THE DRAWINGS

Further objects and features of the invention will be readily apparent to those skilled in the art from the specification and appended drawings illustrating a preferred embodiment in which:

FIG. 1 is a perspective broken away view of a housing and an access door, showing a preferred embodiment of the door latching and locking device described herein;

FIG. 2 is a front view of the embodiment of FIG. 1, shown in its fully latched position;

FIG. 3 is a cross sectional side view of the embodiment of FIG. 1 taken along the lines 3—3 of FIG. 2;

FIG. 4 is a partial cross sectional front view of the embodiment of FIG. 1, taken along the lines 4—4 of FIG. 3, with the latching mechanism shown in an unlatched position;

FIG. 5 is a partial cross sectional front view of the embodiment of FIG. 1, similar to that of FIG. 4, with the latching mechanism being shown in its fully open position;

FIG. 6 is a partial back view of the embodiment of FIG. 1, with the latching mechanism shown in its fully latched position; and FIG. 7 is a perspective view of another embodiment of the invention, showing the operating head end of the latching mechanism operating shaft;

DESCRIPTION OF A PREFERRED EMBODIMENT

Figure 8:
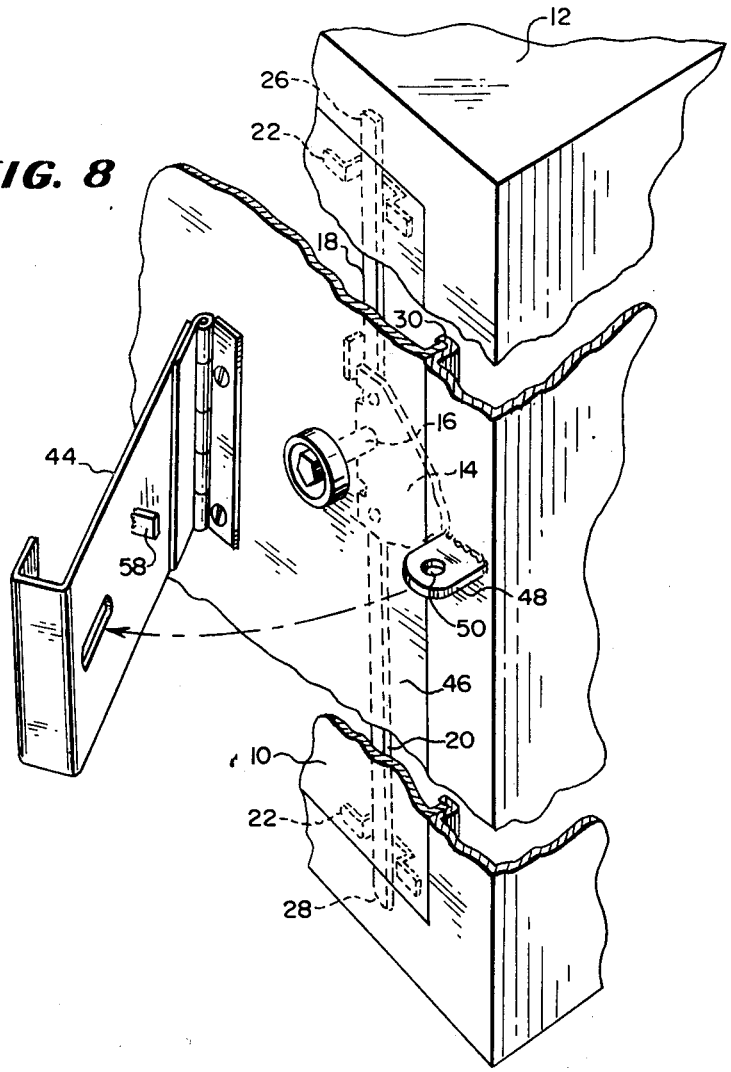
FIG. 8 is a perspective and broken away view of a housing and an access door, showing another embodiment of the door latching and locking device described herein.

In FIG. 1, a door 10 of a housing 12 is shown in a latched unlocked position. The door 10 has a known three-point latching mechanism which includes a latch plate 14 attached to an operating shaft 16 which is rotatably mounted to the door 10. Respective top and bottom lock rods 18, 20 are each pivotably mounted at one end to an opposite side of the latch plate 14, and are both slidably mounted to the door 10 within respective U-shaped brackets 22 fastened on the inside of the door 10. When the door 10 is latched, one end 24 of the latch plate 14, and the opposite ends 26, 28 of the lock rods 18, 20, extend behind respective portions of the door frame 30 to secure the door in its closed position. When the operating shaft 16 is rotated from the latched position shown in FIG. 1 to an unlatched position such as shown in FIG. 4 or 5, the ends 26, 28 of the top and bottom lock rods 18, 20 slide inward toward the operating shaft 16 and the engaging end 24 of the latch plate 14 is rotated downwards so that all three engaging portions 24, 26, 28 of the latching mechanism are disengaged from the door frame 30, and the door 10 can be opened. These engaging members 14, 18, 20 can be designed to be slightly deflected by the door frame 30 when the door 10 is latched to thus exert a force to hold the door 10 tightly closed. To this end, the end portions 26, 28 of the lock rods 18, 20 and the portion 32 of the end 24 of the latch plate 14 shown in FIG. 6, which first make contact with the door frame 30 when the operating shaft 16 is rotated from an unlatched position to a latched position, can be bent slightly inward away from the door 10, to ride up and over the edge of the door frame 30.

As best seen in FIG. 3, a hub member 34 of the latch plate 14 is fastened to the operating shaft 16 by a lock pin 36. The operating shaft 16 extends through the door 10 into the recess formed by a cup washer 38 welded to the door 10. The end of the shaft 16 extending into the recessed portion of the cup washer 38 includes an enlarged head portion 40 which is pentagon in shape as viewed from the front of the door. Two nylon washers 42 are disposed on either side of the cup washer 38 about the operating shaft 16 so that the operating shaft 16 can be easily turned by a special socket wrench tool inserted within the cup washer 38 about the five-sided head 40 of the operating shaft 16. The dimensions of the operating shaft head 40 and of the cup washer 38 conform to those of the recessed cup and penta-head bolt required by the specification U-5 for pad-mounted transformers, issued January 1977 by the Rural Electrification Administration of the U.S. Department of Agriculture. Thus the same operating tool used to secure the special tamperproof penta-headed bolts on the high voltage doors of pad-mounted equipment can be used to operate the latching mechanism according to the present invention.

A locking hasp 44 is pivotably attached by a hinge pin 46 to the outside of the door 10 below the cup washer 38, and a bail 48, containing a hole 50 for receiving the shackle of a padlock, is also attached to the outside of the door 10 above the cup washer 38. When the latch operating shaft 16 is in its fully latched position, the hasp 44 can be rotated upward to rest against the cup washer 38, with the hasp 48 extending through a slot 52 of the hasp 44 so that the shackle 54 of a padlock 56 can be inserted within the hole 50 of the bail 48, as shown in FIGS. 2 and 3. A flat tab member 58 disposed on the inner side of the hasp 44 projects into the cup washer 38 against a top side 60 of the operating shaft head 40, which is positioned at the top of the head 40 when the shaft 16 is in its latched position, to lock the latching mechanism operating shaft 16 in its latched position. Without this locking tab 58, the latching mechanism would be held in its fully latched position only by the frictional contact between the door frame 30 and the engaging ends 24, 26, 28 of the lock rods and latch plate 26, 28, 24, and thus the door 10 could be unlatched by the rotation of the shaft 16 by a person within the housing 12, or by vibrational forces, even though the hasp 44 was padlocked in its closed position.

The latch plate 14 has an angled top edge 62 extending to the engaging portion 24 of the plate 14, which allows the latch plate 14 to disengage from the door frame 30 when the operating shaft 16 is rotated less than 72° from its fully latched position, as shown in FIG. 4. This assures that only the surface 60 of the operating shaft head 40 can be disposed horizontally at the top side of the head 40 to receive the locking tab 58 when the door 10 is latched. Thus the hasp 44 cannot be closed and locked except when the operating shaft 16 is disposed in its fully latched position.

Also, a stop 64 can be disposed on the inner side of the door 10 to make contact with the latch plate 24 when it is rotated counterclockwise through its fully latched position to thus prevent this latch plate 24 from being rotated beyond its fully latched position, as best seen in FIGS. 1 and 6. Also, this stop 64 can be used to limit the clockwise rotation of the latch plate 24 to its fully unlatched position as shown in FIG. 5, to thus prevent bending of the lock rods 18, 20 against the hub member 34 of the latch plate 24, which could occur if the latch plate 24 were rotated clockwise beyond its fully unlatched position.

The end of the hasp 44 has a bent over portion 66 which is U-shaped in cross section, as seen in FIG. 3 which serves as a sleet shield for the padlock and bail 48 when the hasp 44 is in its fully closed position, and as a handle for opening the door when the hasp 44 is in an extended position as illustrated in FIG. 1.

As illustrated herein, the bail 48 consists of a plate welded to the door 10 which defines a hole 50 for receiving a padlock shackle. However, this bail 48 can include a ring or plate member defining a hole which is rotatably mounted to a shank portion attached to the door 10 so that after the hasp 44 has been moved to its fully closed position, the outer portion of the hasp 48 can be rotated 90° to thus hold the hasp 44 in its fully closed position.

The combination locking system described herein is advantageous in that the tamperproof operating head 40 must be rotated to latch the door 10, whereas in prior known tamperproof door securing systems in which a separate latching mechanism is used, the door could be latched without additionally securing it with the tamperproof bolt.

As shown in the drawings, the cylindrical side walls of the cup washer 38 extends outward from the surface of the door 10; however, the cup washer 38 can just as easily be disposed on the door 10 so that the open end of the cylindrical wall is flush with the outer surface of the door 10, so long as the hasp is shaped so that it completely covers the end of this cup washer 38 when the hasp 44 is in its fully closed position.

Also, while only a cup washer 38 and an operating head 40 conforming to the dimensions of the R.E.A. approved tamperproof securing bolt for high voltage doors of pad-mounted transformers is illustrated in the drawings, other types of tamperproof operating heads 40 can be used equally as well. For example, this operating head 40 could be cylindrical in shape, with only one flattened surface 60 against which the tab 58 extends, in which case, the door 10 could only be locked in its fully latched position. Also, this operating head 40 could be generally cylindrical in shape with two orthogonal flattened sides, in which case the door 10 could be locked only in its fully latched or its fully unlatched positions.

Also, the surface against which the tab 58 extends to lock the operating shaft 16 does not need to be a surface which is acted upon by an operating tool to rotate the operating shaft 16. Any surface of the head 40 which defines a non-axially oriented open space within the cup washer 38 for receiving an index tab of the hasp therein will suffice. For example, the flat end surface of the operating head 40 can be slanted relative to the axis of the operating shaft 16, that is, disposed in a plane which is non-orthogonal to the shaft axis, in which case, the index tab could be in the form of a cylinder also having a slanted flat end surface which lies against the corresponding end surface of the operating head 40 when the operating shaft 16 and the hasp 44 are both in the fully closed position. Similarly, the operating head 42 could have a concave or convex end surface shaped to fit a partial cylindrical shaped index tab 58.

In another embodiment, shown in FIG. 7, the end of the operating head 40 can be so shaped as to allow the operating shaft to be turned by a screwdriver in one direction only, by having displaced opposite surfaces 68, 70 against which opposite sides of a screwdriver can be pressed to turn the head 40 in one direction, and opposite curved ramp surfaces 72, 74 upon which the end of the screwdriver will slide when turned in an opposite direction. Thus, the end surface of the five-sided operating head 40 could be shaped so as to allow the door 10 to be latched and locked by means of a screwdriver, but which would allow the door 10 to be unlatched only by the use of a special five-sided socket wrench type of tool. Then, even if the special operating tool were misplaced or broken, the door 10 could still be latched and locked. In the embodiment of FIG. 7, the index tab 58 can be disposed on the hasp 44 either to lock against the side surface 60 or against the end surfaces 68, 70.

While only a three-point latching mechanism is illustrated in the drawings, the mechanism shown can be converted into a one point latching mechanism by removing the lock rods 18, 20, or into a two-point latching system by removing only one of the lock rods 18, 20, or positioning the operating shaft 16 so that no portion of the latch plate 14 extends into or behind the frame 30.

Also, while only a hinged door 10 has been illustrated, the latching and locking mechanism described herein can be used with other types of movable panels, such as sliding doors, or removable access covers, having any type of known latching mechanism which is operated by the rotation of a shaft extending through the door and rotatably mounted therein, between respective latched and unlatched positions.

In yet another embodiment of the invention, shown in FIG. 8 the bail 48 can be disposed on an outside surface of the housing 12 adjacent the door 10 rather than on the door 10 itself, with the hasp 44 still being pivotably mounted to the door 10 on the side of the cup washer 38 opposite the bail 48 so that when the hasp 44 is closed, the door 10 is secured to the housing 10 both by the locking tab 58 and by the shackle 54 of the padlock 56 extending through the hole 50 of the bail 48. In such an arrangement, if the special operating tool for the five-sided shaft head 40 were misplaced, the latch plate 14 could be manually disposed in an unlatched position so that the tab 58 will fit against another one of the sides of the head 40 when the hasp 44 is closed, and the door 10 could still be secured and locked to the housing 12 by the padlock 56, until another operating tool for the shaft head 40 is obtained.

Obviously numerous modifications and variations of the present invention are possible in light of the above teachings. It is therefore to be understood that within the scope of the appended claims, the invention may be practiced otherwise than as specifically described above.

What is claimed is:

1. In an electric power distribution equipment housing having an access door with a door latching mechanism which includes an operating shaft rotatably mounted to the door, one end of the shaft extending out one side of the door to permit rotation of the operating shaft between a fully latched position and an unlatched position, the improvement wherein said door is unlatched when said shaft is rotated less than 72° from its fully latched position, and said one end of said operating shaft is disposed within a recess defined by the surface of said one side of said door, said one end of said shaft comprising a five-sided shaft head which conforms to dimensional requirements of a pentahead bolt specified by the Rural Electrification Administration (R.E.A.) of the U.S. Department of Agriculture for securing an access door of an electric power distribution equipment housing, and said recess of said door conforming to dimensional requirements of a recess cup specified by said Rural Electrification Administration for use with said pentahead bolt; said improvement further comprising:

a bail, extending from said one side of said door on one side of said recess, which defines an opening therethrough for receiving a shackle of a padlock:

a hasp, pivotably mounted at one end to said side of said door on an opposite side of said recess or rotation between an open position and a closed position, having inner and outer surfaces defining a slot therethrough for receiving said bail as said hasp is rotated into its closed position, said hasp extending over said recess to prevent access to said shaft end therein when said hasp is closed; and an index tab, disposed on said inner surface of said hasp, which projects into said recess adjacent a respective side of said five-sided shaft head, only when said shaft is in its fully latched position, and said hasp is in its closed position, to thereby lock said shaft in its fully latched position;

whereby said door can be padlocked closed only when said operating shaft is disposed in its fully latched position, an operating tool for said R.E.A. bolt can be used to unlatch said door when said hasp is in its open position, and said hasp can be used as a handle means for opening said door.

2. An improved door latching and locking mechanism, as described in claim 1, wherein an opposite end of said hasp comprises an offset portion which extends over said bail when said hasp is in its closed position, whereby said offset portion serves as a sleet shield for said bail when said hasp is closed, and also as said handle means for opening said door.

3. An improved panel latching and locking mechanism, as described in claim 1, wherein said five-sided shaft head includes an end surface means for allowing rotation of said shaft by a screwdriver in only one direction of rotation, away from its unlatched position toward its latched position.

4. In an electric power distribution equipment housing having an access door with a latching mechanism which includes an operating shaft rotatably mounted to the door, one end of the shaft extending outside the housing from an outside surface of the door to permit rotation of the operating shaft between a fully latched position and an unlatched position, the improvement wherein said door is unlatched when said shaft is rotated less than 72° from its fully latched position and said one end of said operating shaft is disposed within a recess defined by said outside surface of said door, said one end of said shaft comprising a five-sided shaft head which conforms to dimensional requirements of a pentahead bolt specified by the Rural Electrification Administration (R.E.A.) of the U.S. Department of Agriculture for securing an access door of an electric power distribution equipment housing, and said recess of said door conforming to dimensional requirements of a recess cup specified by said Rural Electrification Administration for use with said pentahead bolt, said improvement further comprising:

a bail, extending from an outside surface of said housing adjacent said door on one side of said recess, which defines an opening therethrough for receiving a shackle of a padlock;

a hasp, pivotably mounted at one end to said outside surface of said door on an opposite side of said recess for rotation between an open position and a closed position, having inner and outer surfaces defining a slot therethrough for receiving said bail as said hasp is rotated into its closed position, said hasp extending over said recess to prevent access to said shaft end therein when said hasp is closed; and an index tab, disposed on said inner surface of said hasp, which projects into said recess adjacent a respective one of said five sides of said shaft head, only when said shaft is in its fully latched position and said hasp is in its closed position, to thereby lock said shaft in its fully latched position.

* * * * *